US006227339B1

(12) United States Patent
Bogert

(10) Patent No.: US 6,227,339 B1
(45) Date of Patent: May 8, 2001

(54) UPRIGHT STANDING DUFFLE BAG

(75) Inventor: Christina Bogert, Crawford, NJ (US)

(73) Assignee: Monarch Luggage Company, Inc., New York, NY (US)

( * ) Notice: Subject to any disclaimer, the term of this patent is extended or adjusted under 35 U.S.C. 154(b) by 0 days.

(21) Appl. No.: 09/336,240

(22) Filed: Jun. 18, 1999

(51) Int. Cl.[7] ..... A45C 7/00; A45C 5/14; A45C 13/36

(52) U.S. Cl. ..... 190/18 R; 190/107; 190/122; 190/127

(58) Field of Search ..... 190/18 A, 107, 190/122, 127, 103

(56) References Cited

U.S. PATENT DOCUMENTS 4,588,056 * 5/1986 Bernbaum ..... 190/107
4,629,040 * 12/1986 Jones ..... 190/127 X
4,895,230 * 1/1990 King ..... 190/107
4,951,818 * 8/1990 Johnson ..... 190/107 X
4,953,673 * 9/1990 Ambasz ..... 190/127 X
5,022,574 * 6/1991 Cesari ..... 190/127 X
5,105,919 * 4/1992 Bomes et al. ..... 190/18 A
5,197,580 * 3/1993 Berman et al. ..... 190/18 A X
5,253,739 * 10/1993 King ..... 190/18 A
5,515,954 * 5/1996 Nordstrom ..... 190/18 A
5,524,737 * 6/1996 Wang ..... 190/18 A
5,749,446 * 5/1998 Hsieh ..... 190/18 A X
6,021,874 * 2/2000 Nykoluk ..... 190/18 A X

* cited by examiner

*Primary Examiner*—Sue A. Weaver
(74) *Attorney, Agent, or Firm*—Stroock & Stroock & Lavan LLP

(57) ABSTRACT

A generally-rectangular duffle bag is provided which includes a front panel, a rear panel, a first side panel, a second side panel, a top panel, and a rear panel. The front panel is connected and spaced from the rear panel by the top, bottom, first side and second side panels. Support structures are also provided for supporting the body in two orientations, such orientations being substantially 90° apart.

11 Claims, 8 Drawing Sheets

FIG. 10
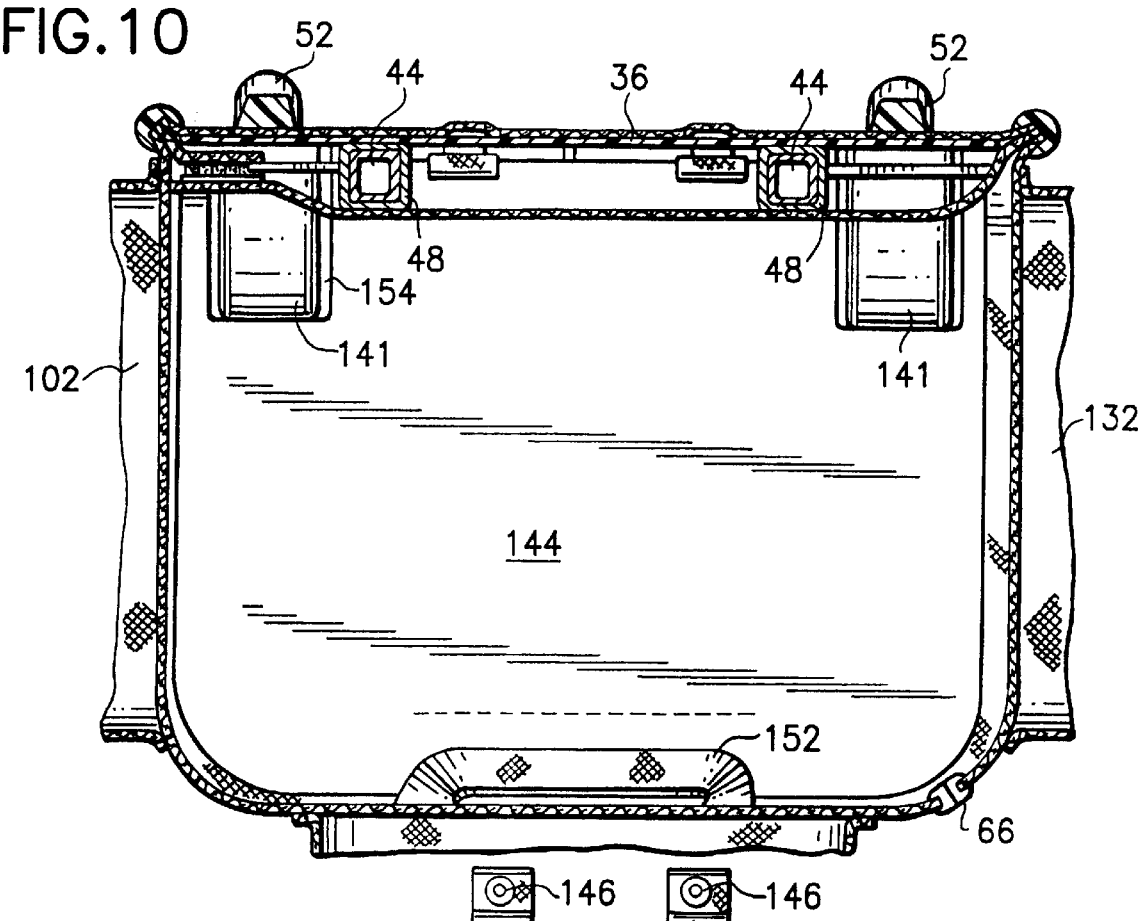
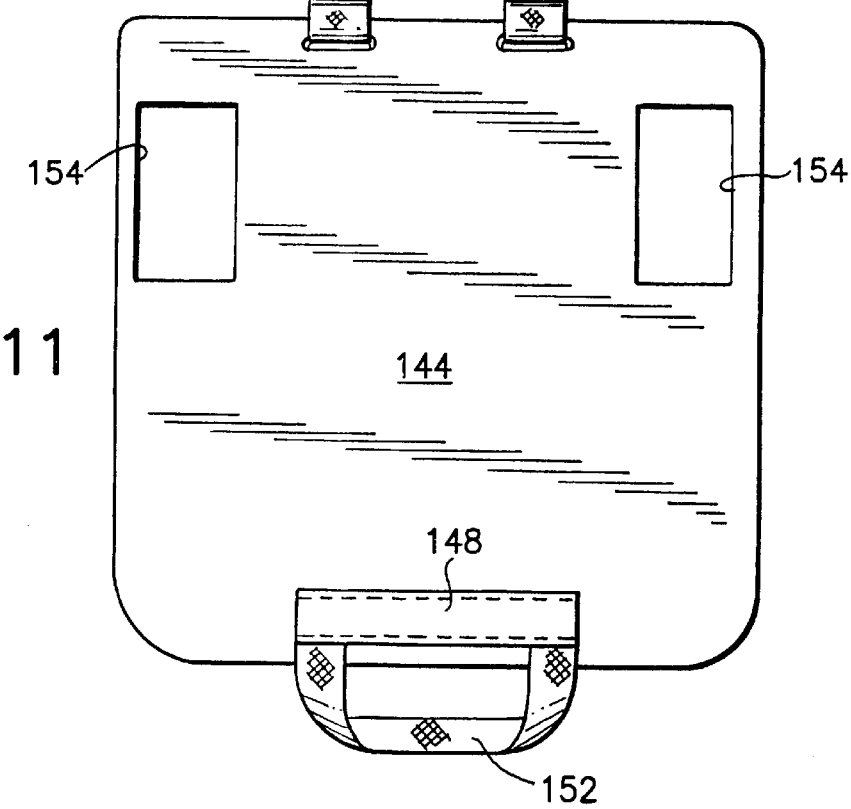
FIG. 11

UPRIGHT STANDING DUFFLE BAG

BACKGROUND OF THE INVENTION

This invention is directed to a soft luggage piece, in particular, a Pullman style duffle bag, and even more particularly a wheeled upright standing duffle bag.

Duffle bags are well known in the art. Generally, duffle bags are made of soft materials on all sides to form an enclosure. Duffle bags are usually rectangular in shape, in other words, they are longer than they are wide. An opening is provided in duffle bags providing access to the interior of the duffle bag along a major access, i.e. along its length. These conventional duffle bags, most popularized for use when camping or for use by soldiers, have been satisfactory however, they were required to be carried over the shoulder leading to fatigue. Furthermore, because the entire structure was soft, they did not provide stability while filling or emptying the duffle bag.

To overcome these shortcomings in the prior art, it is also known to provide a bottom to a duffle bag by providing some type of rigid structure within the duffle bag along one surface, nominally a long side of the duffle bag to provide stability to the duffle while the duffle bag is loaded from the opposed side. It is also known to provide skids or feet along the support structure and even wheels on one corner of the support structure. The remaining sides of the duffle bag are soft to maximize the capacity of the duffle bag interior while allowing the bag to fold upon itself for storage.

Accordingly, it is desired to provide a duffle bag which maintains the functionality of a duffle bag as a result of soft-sided enclosure while providing stability for a duffle bag in an upright position without interfering with its ability to collapse upon itself for storage.

SUMMARY OF THE INVENTION

A stable upright Pullman style duffle bag has a front panel, a first side panel, a second side panel, a back panel, a top panel and a bottom panel; all integrally formed affixed to each other to form a duffle bag body. The front panel includes a flap which is selectively sealed to the front panel to selectively provide access to the interior of the duffle bag body. An internal support member is disposed against an internal face of the back panel and bottom panel. At least one handle is provided extending from the top panel. Wheels, affixed to the support member, extend from one side of the bottom panel. Feet are affixed to the support member at the bottom panel a spaced distance from the wheels.

In a preferred embodiment, the internal support member disposed adjacent the bottom panel includes a first rigid panel which is removable from the bottom panel and a second rigid panel which is foldable upon itself or a second rigid panel and third rigid panel; the second rigid panel being pivotable relative to the third rigid panel. At least one pocket is affixed to at least one of the front or side panel. The pocket has an opening therein facing toward the side panel. Furthermore, the at least one handle is a collapsible handle mounted to the internal support. Additionally, an external support such as skids, feet or the like are mounted to the internal support along the back panel.

Accordingly, it is an object of the invention to provide an improved duffle bag.

Still another object of the invention is provide a Pullman style duffle bag with sufficient stability to stand upright while being used.

Yet another object of the invention is to provide a duffle bag capable of stably standing upright while being collapsible for storage.

A further object of the invention is provide a Pullman duffle bag capable of taking advantage of pockets which open at the top providing easier access for the user.

Still other objects of the invention will, in part, be obvious and will in part, be apparent from the specification.

The invention accordingly comprises features of construction, combination of elements, and arrangement of parts which will be exemplified in the construction hereinafter and the scope of the invention will be indicated in the claims.

BRIEF DESCRIPTION OF THE DRAWINGS

For a fuller understanding of the invention, reference is had to the following description taken in connection with the accompanying drawings, in which:

FIG. 10 is a sectional taken along line 10—10 of FIG. 1;

FIG. 11 is a top plan view of a removable support member constructed in accordance with the invention.

DETAILED DESCRIPTION OF THE PREFERRED EMBODIMENT

Figure 1:
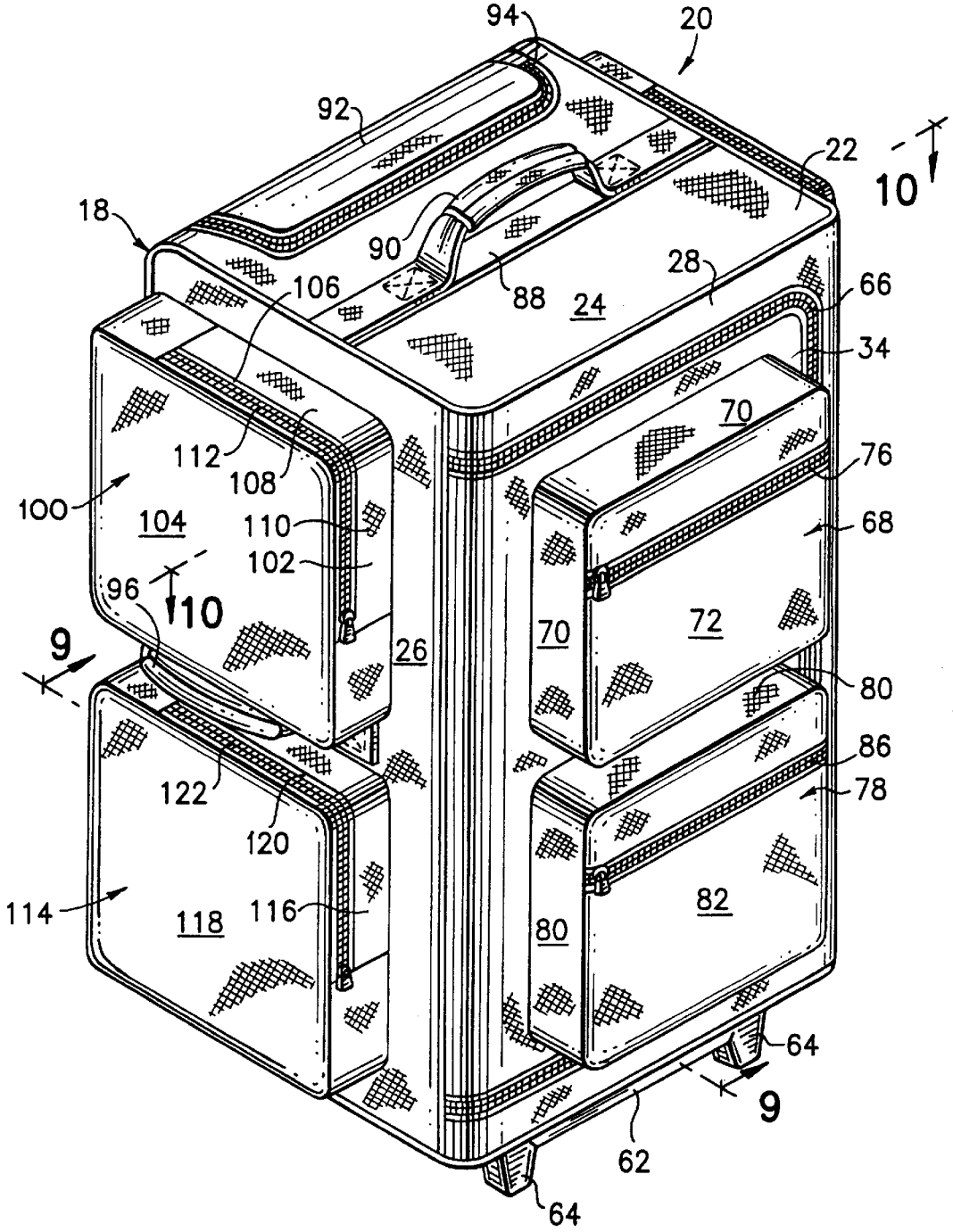
FIG. 1 is a perspective view of a Pullman style duffle bag constructed in accordance with the invention.
Figure 3:
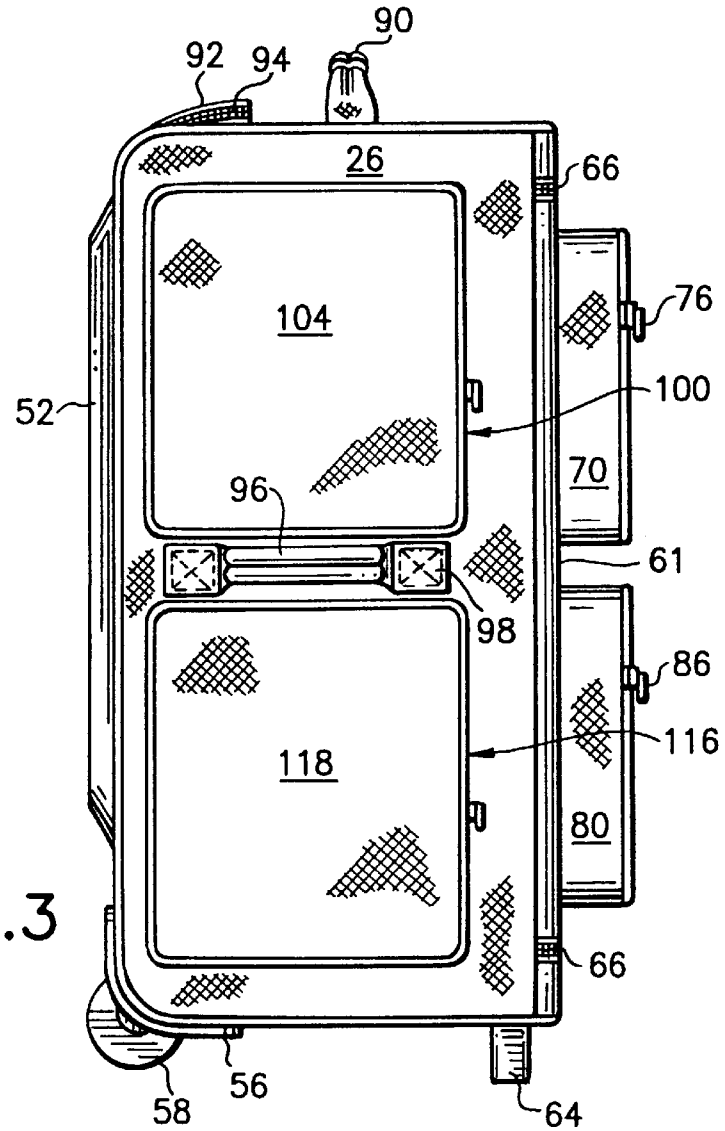
FIG. 3 is a left side elevational view of the duffle bag constructed in accordance with the invention.
Figure 2:
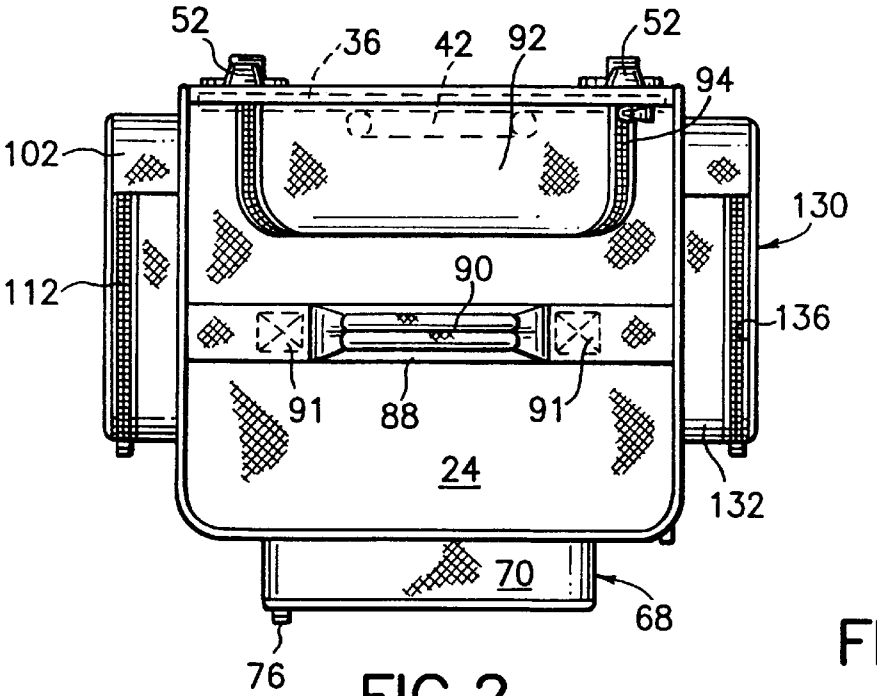
FIG. 2 is a top plan view of the duffle bag constructed in accordance with the invention showing a collapsible handle in phantom.
Figure 5:
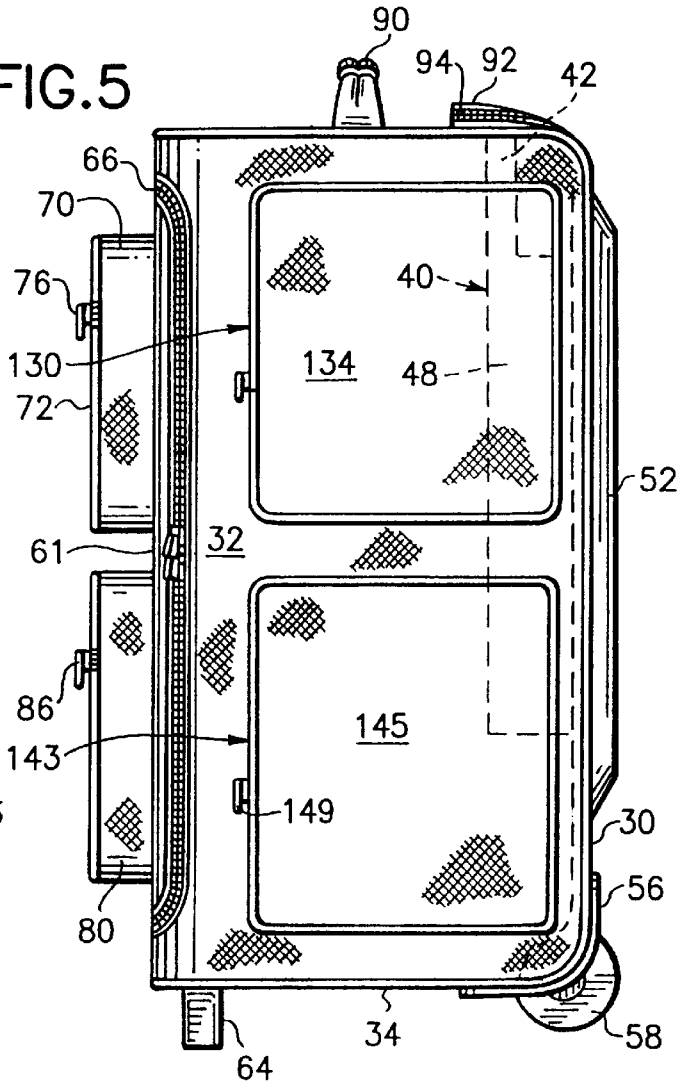
FIG. 5 is right side elevational view of the duffle bag constructed in accordance with the invention showing the handle assembly and internal support member in phantom.

Reference is made to FIGS. 1 through 7, a Pullman style duffle bag generally indicated as 20 has a soft sided body 18 which is generally rectangular in shape. Body 18 includes a front face panel 28 and a rear face panel 30 which are interconnected and spaced apart from each other by a top panel 24, a bottom panel 34, a left-side panel 26 and a right side panel 32.

Reference is specifically made to FIGS. 5–11 wherein the internal support structure for duffle bag 20 is shown.

A rigid member has a rear plate portion 36 formed of a light weight material which is disposed adjacent an interior surface of rear panel 30. The rigid member extends into a bottom plate portion 38 disposed along an interior surface of bottom panel 34. Rear plate portion 36 and bottom plate portion 38 can be formed as a single member or formed as two members joined adjacent the corner formed by rear panel 30 and bottom panel 34.

Duffle bag 20 includes a retractable handle assembly generally indicated at 40, and as known in the art, retractable handle assembly 40 has a general U-shaped extending member 42 having a pair of co-parallel tubular rods 44 attached at opposite ends of the handle 46. A pair of tubular housings 48 affixed to rear plate portion 36 are adapted to receive a respective one of tubular rods 44. Tubular housings 48 are connected at the top thereof and the bottom thereof by cross arms 50 which provide stability to respective tubular housing 48. Each of rods 44 is slidably received by a respective housing 48.

Runners 52 are disposed on an exterior surface of rear panel 30 and are affixed to rear plate portion 36 by rivets 65 by way of example. Runners 52 provide support for body 22 when body 22 is oriented to lie on its back to provide stability when filling or emptying duffle bag 20 as described below. In a preferred embodiment, rear plate portion 36 is substantially co-extensive with the rear panel 30 to provide a sufficient structure to support both handle assembly 40 and runners 52 and at least large enough so that runners 52 may be spaced apart sufficiently to provide support and a stable platform for duffle bag 20 when resting on its back.

Wheel mounts 56 are disposed at a lower end of rear panel 30 and a rear end of bottom panel 34. A respective wheel 58 is rotatably supported within a respective one of wheel mounts 56 and extends from the corner of body 22 formed by rear panel 30 and bottom panel 34.

A foot 60 is disposed on a bottom surface of bottom panel 34, a distance from wheel 58. In a preferred embodiment, foot 60 is closer to a corner formed by a bottom panel 34 and front panel 28 then to wheel 58. Foot 60 is attached to bottom portion 38 of the internal support structure by a rivet 63 by way of example. In the exemplary embodiment shown in FIGS. 6 and 7, foot 60 is shown as a crossbar 62 having spaced projections 64 extending therefrom. It should be understood that, foot 60 could also be formed as two separate feet corresponding to projection 64 or one solid projecting foot extending for a length across bottom panel 34. By giving some length to foot member 60 and spacing foot 60 from wheels 58, a sturdy stable platform is provided for supporting duffle bag 20 in an upright position.

Although bottom portion 38 can be formed as a continuous extension from rear plate portion 36, in a preferred embodiment, bottom portion 38 of the plate is an assembly. Bottom portion 38 includes a first plate member 140 which extends substantially from runner 52 around the corner formed by bottom panel 34 and real panel 30. First plate 140 is formed of a rigid material and in a preferred embodiment includes wheel housings 141 which protect articles within body 22 from wheels 58 extending into duffle bag 20. A second rigid plate member 142 extends from plate 140 to at least the position along panel 34 corresponding to foot 60. It is not necessary that plates 140 and 142 abut, in fact, for reasons to be stated below, there may in fact be a small gap therebetween or the two may slightly overlap. However, what is required is that plate 142 is capable of movement towards plate 140 as will be described below. In effect, a hinge is formed by plates 140 and 142. Plates 140 and 142 could be replaced by a single hinged plate.

Although not required for functionality, in a preferred embodiment, a third plate 144, substantially coextensive with plates 140 and 142, is disposed within body 22 and between the interior of body 22 and plates 140 and 142. It is not necessary that plate 144 be coextensive with plates 140 and 142, but what is required is that it substantially extend beyond the virtual hinge formed by plates 140 and 142 and be affixed to body 22. By being affixed to body 22 and extending beyond the virtual hinge, during use plate 144 provides stability and prevents panel 34 from folding about the hinge while in use to hold clothing.

In a preferred embodiment, plate 144 is removable and includes connectors 146 for affixing to a mating connector on either one of first rigid member 140 or rear plate portion 36. In a preferred embodiment, the mating connectors are snaps, but could easily be Velcro hook and fastener, slots and inserted tabs, or the like. At an opposite end, a second fastener 148 is provided which mates with reciprocal fastener 150 affixed to second rigid plate member 142. In a preferred embodiment, fasteners 148, 150 are Velcro® hook type fasteners, but may be snaps, tabs and slots, or the like. A handle 152 is provided at one end of plate 144 to facilitate removal of the plate 144 from the interior of body 22. Furthermore, to ensure a flush fit and conserve material, cut outs 154 are formed in plate 144 to receive wheel housings 141. When plate 144 is removed, then plate 142 can be folded towards plate 140 as will be described in greater detail below.

Figure 4:
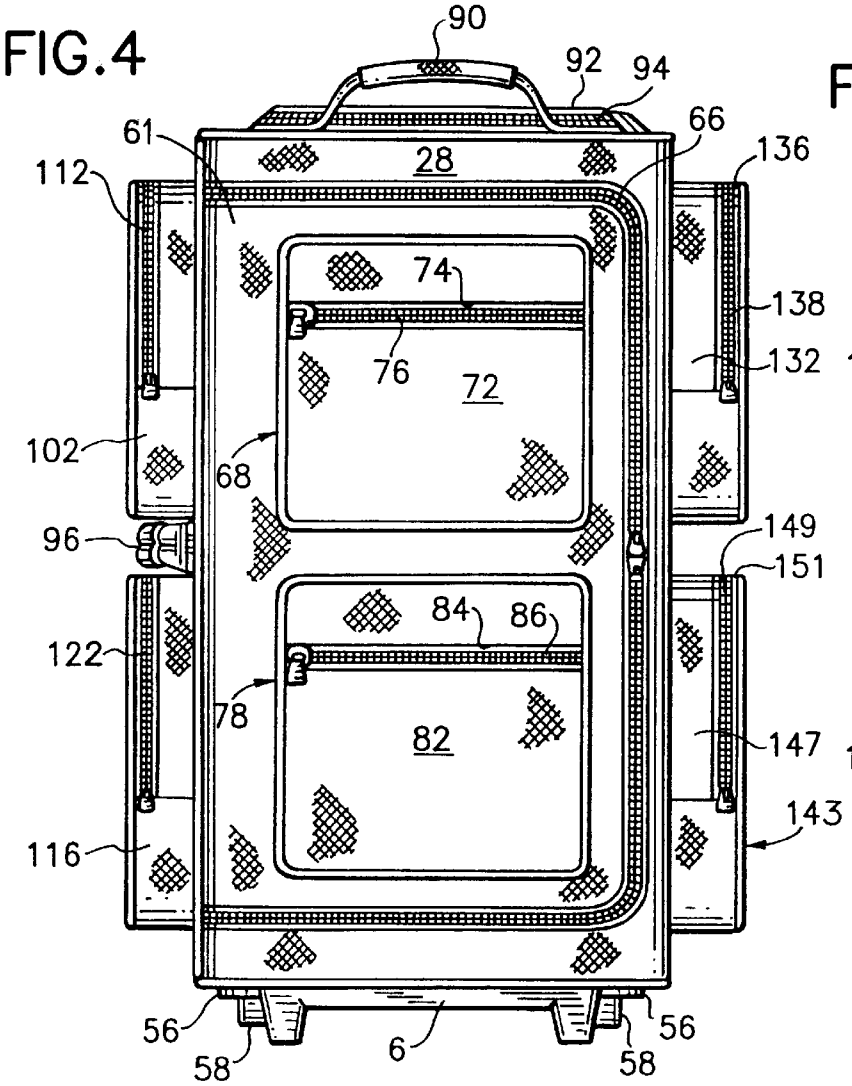
FIG. 4 is a front elevational view of the duffle bag constructed in accordance with the invention.
Figure 7:
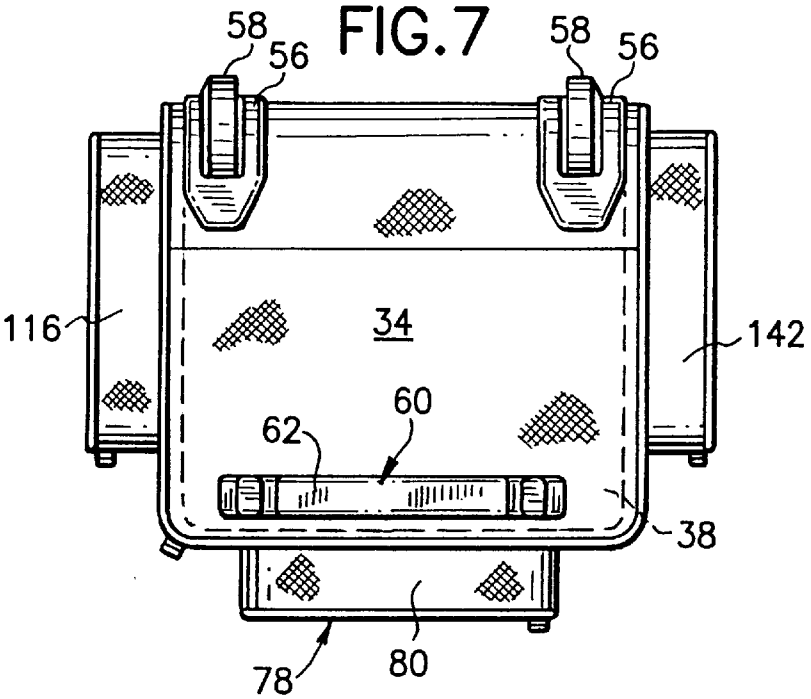
FIG. 7 is a bottom plan view of the bag showing a bottom portion of the internal support structure in phantom.

Reference is made more particularly to FIGS. 1 and 4 in which a door panel 61 disposed within front panel 28 is shown. Door panel 61 is a substantially U-shaped panel which is affixed to side panel 26 along one side. Door panel 61 provides access to the interior of body 22. A zipper 66 extends along the three sides of door panel to selectively close door panel 61 to close off the interior of body 22.

An upper pocket 68 is mounted on front panel 28, front panel 28 serving as a back wall to pocket 68. A side wall 70 affixed to door panel 61 forms an area which enclosed by a pocket top panel 72. Panel 72 is formed with a slit 74 therein which is selectively closed by a zipper 76. A second pocket 78, being substantially identical to the structure to pocket 68 is also mounted on door panel 61 and is formed of a side wall 80, top panel 82 having a slit 84 therein which is selectively closed by a zipper 86.

A support strap 88 extends across top panel 24. A handle 90 is affixed to support strap 88 and extends away from top panel 24. Handle 90 may be utilized to lift duffle bag 20 and also to wheel duffle bag 20 by grasping handle 90 and titling body 22 towards the rear so that body 22 is supported only by the wheel. Handle 90 is affixed to support strap 88 at least in part by stitching 91 in an exemplary embodiment, however handle 90 may be affixed to strap 88 by adhesive bonding, lamination or other bonding techniques.

Figure 6:
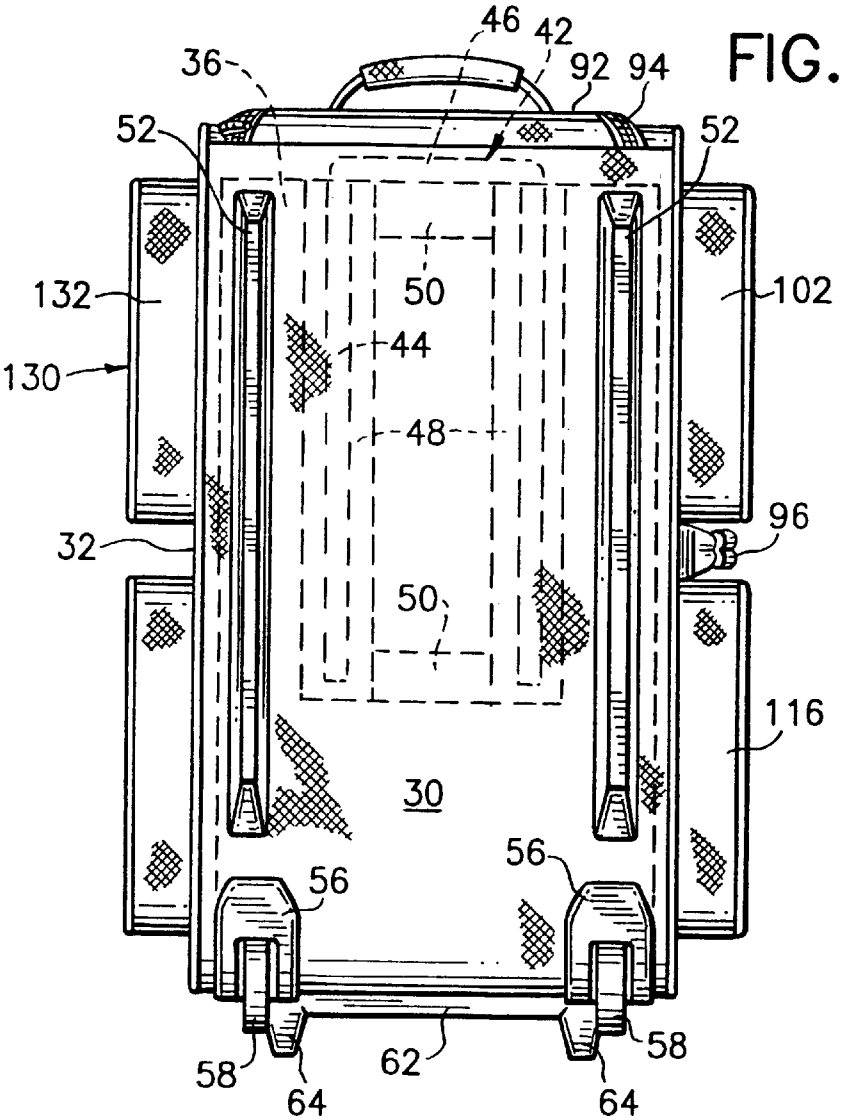
FIG. 6 is a rear elevational view showing the internal support and handle frame assembly in phantom.

For taller users, grabbing handle 90 may require some leaning over and stretching down, fatiguing the back and causing discomfort. For this reason, handle assembly 40 with extendible handle 42 is provided. A door flap 92 having a substantially U-shape is formed on top panel 24 and affixed to body 22 along rear panel 30. A zipper 94 extends along three sides of door panel 92. Door panel 92 provides access to handle 42 which may be pulled to extend from body 22 for a length convenient to the user. When collapsed handle 42 stays within body 22 as shown in FIG. 6 and is hidden from view by door panel 92 improving overall aesthetics of duffle bag 20. Zipper 94 closes panel 92 sealing off handle 42.

Each of the panels of duffle bag 20 as well as each of the pockets is preferably made of a lightweight deformable material such as vinyl, fabric, canvas or plastics which can not readily support their own weight.

A third handle 96 may be provided on a side panel, such as side panel 26 to allow for carrying or moving of duffle bag 20 without wheeling. Handle 96 may be affixed to side panel 26 either by stitches 98, lamination or bonding as is known in the art. A first side pocket 100 is affixed to side panel 26 and is formed as a side wall 102 encircling an area which is enclosed by a top panel 104. A slit 106 is formed in an upper portion 108 of side wall 102 and may extend along a portion of a side portion 110 of side panel 102. Slit 106 provides access to the interior of pocket 100 and may be selectively closed by a zipper 112 provided therein. Zipper 106 substantially opens to be accessed from a top direction of duffle bag 20. A second pocket 114 is provided on side panel 26. It may be similar in construction to side pocket 102 and includes a side wall 116 encircling an area enclosed by a top wall 118. A slit 120 provides access to the interior of pocket 114, and may be selectively closed by a zipper 122 provided therein.

Side panel 32 may be similar in construction with side panel 26 and includes a first top opening pocket 130 having a side wall 132 encircling an area enclosed by a top 134. A slit 136 is provided in side wall 132 to provide access to the interior pocket 130 which may be selectively closed by zipper 138 disposed therein. Similarly, a second pocket 143 may also be disposed on side panel 132 and includes a side wall 147 forming an area enclosed by a top panel 145. A slit 151 is provided in side wall 147 for providing access to the interior of pocket 143 which may be selectively closed by a zipper 149.

During operation, duffle bag 20 is rotated onto its back and rests on skids 52. Skids 52 in effect provides a platform and floor for supporting body 22 of duffle bag 20. Zipper 66 is unzipped and door panel 61 is opened to provide access to the interior of body 22. Body 22 is then filled with clothing, personal possessions, or whatever else is being packed into the duffle bag. Door panel 61 is then closed and secured by zipper 66. The bag is then rotated about wheels 58 so that foot 64 contacts the ground. This provides a stable platform for the duffle bag in the upright position. In this position, the handles 90 and 42 are more easily accessible to the bag user. Furthermore, access to pockets 68, 78, 130, 140, 100 and 116, (collectively the side pockets) is provided. Each of the side pockets which is top opening may now be easily accessed to either put possessions in or remove possession from without needing to bend down to reach a lower lying duffle bag or without opening flap 61.

Figure 8:
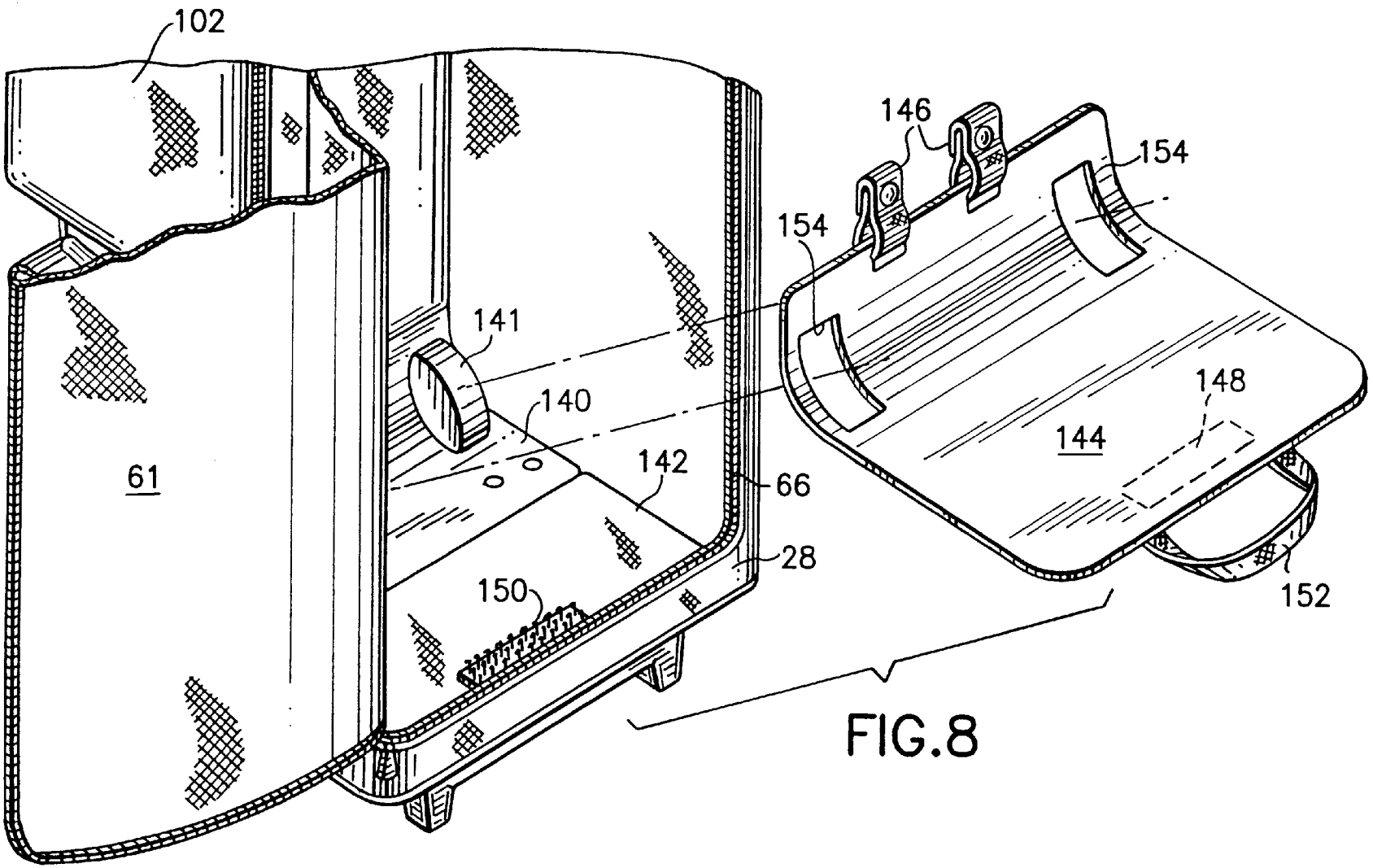
FIG. 8 is a perspective exploded view of a support member.
Figure 9:
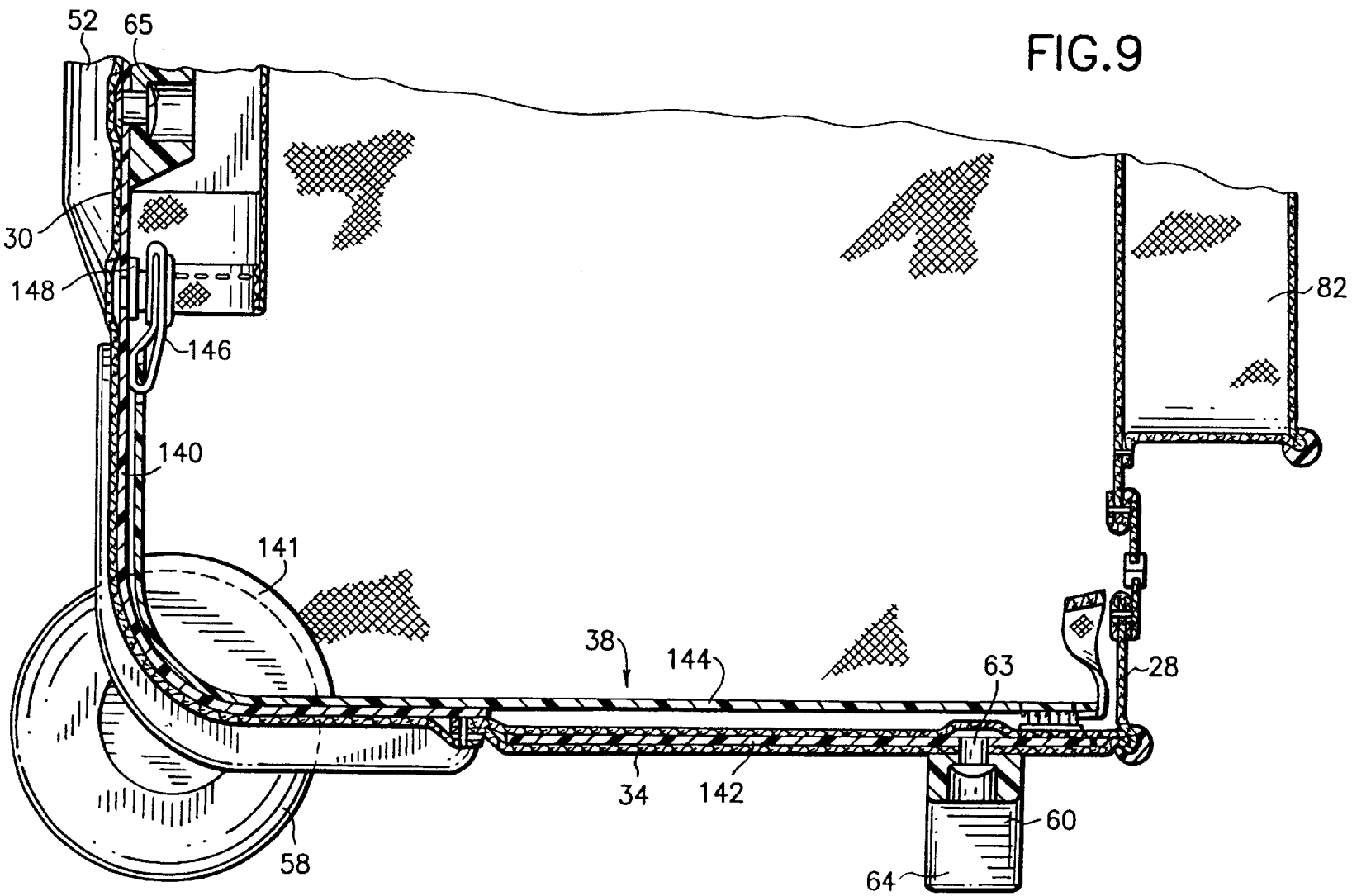
FIG. 9 is a sectional view taken along line 9—9 of FIG. 1.
Figure 12:
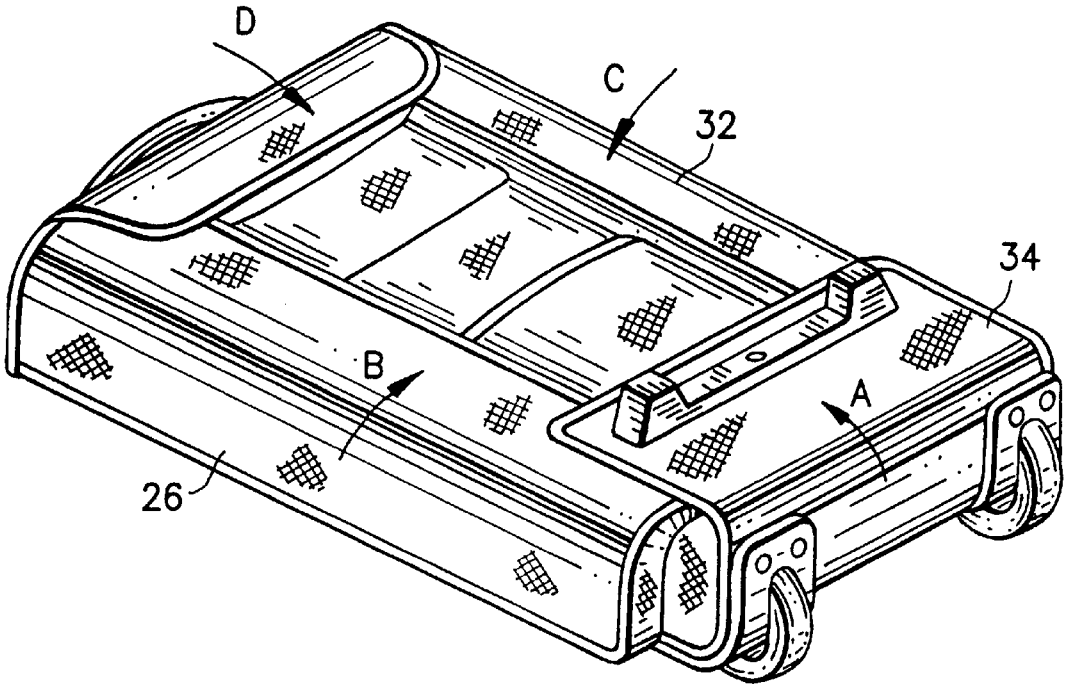
FIG. 12 is a perspective view of a Pullman-style duffle bag collapsed for storage in accordance with the invention.

Reference is now made specifically to FIGS. 8 and 12 in which folding duffle bag 20 for storage is shown. Once duffle bag 20 has been emptied after use, it can then be collapsed upon itself for easy storage. Each of the panels forming body 22 as well as the panels of the pockets are preferably made of a lightweight malleable material such as vinyl, fabric, canvas, or non-rigid plastics. Therefore, absent a supporting member, they will collapse upon themselves with the slightest force applied thereto. In effect, duffle bag 20 is a soft-sided piece of luggage. Panel 144 is released and removed from bottom panel 34. This allows second rigid panel 142 to move relative to first rigid panel 140. Therefore, first bottom panel 34 can be folded in the direction of arrow A in FIG. 12 along the break line (the virtual hinge) between first member 140 and second plate member 142. As this is done, side panels 26, 32 are folded in the directions of arrow B and C respectively to collapse the sides amongst themselves and top panel 24 is folded in the direction of arrow D so that the entire duffle bag can be collapsed against back panel 30. In this way, the duffle bag is in effect flattened to be easily stored under a bed, in a closet, or the like.

This allows the duffle bag having both a stable back and bottom platform to fold against itself as would a soft bag without such stability or platforms.

It should be noted, that the side pocket duffle bag configuration is made by way of example. For example, the side panel need not have side bags or may be provided with less than two side pockets or more than two side pockets. However, by providing a support structure having a lower panel support portion with feet, a stable platform is provided that allows easy access for top opening side pockets. Furthermore, by providing a support structure for a soft sided bag which has an internal support structure for both a lower panel and a rear panel, a stable platform is provided for the duffle bag in two orientations (on its back and on its bottom). Furthermore, a support structure helps to maintain the integrity of the bag while in each of these positions, in other words the rear support panel helps hold the bag upright and provides stability along a height of the bag while in the upright position and the lower support portion helps provide stability to maintain the shape of the bag when it is resting on its back and being filled. Furthermore, by providing a pocket utilizing a top closing clasp which permits access to an extendible handle while keeping the handle from view when in a collapsed position, the overall aesthetics of the bag are improved. Furthermore, in the above embodiments, the support portions 36 and 38 are substantially co-extensive with rear panel 30 and bottom panel 34. However, it may not need these dimensions and need only be large enough to provide support for handle assembly 40, and to separate foot 60 from wheels 56 sufficiently to provide a stable base for body 22 and in the upright position.

By providing an assembly forming the bottom platform, in which a first rigid member and a second rigid member are affixed to the bottom panel yet free moving relative to each other and a third member extends across both of the first and second members, the third member being removable, a solid bottom platform is provided while allowing for the bottom to act as a soft panel as well collapsing upon itself.

It will thus be seen that the objects set forth above, among those made apparent from the preceding description, are efficiently attained and, since certain changes may be made in carrying out the above construction without departing from the spirit and scope of the invention, it is intended that all matter contained in the above description and as shown in the accompanying drawings shall be interpreted as illustrative and not in a limiting sense.

It also to be understood that the following claims are intended to cover all the generic and specific structures of the invention herein described and all statements of the scope of the invention which, as a matter of language might be said to fall therebetween.

What is claimed is:

1. A duffle bag comprising:

a front panel;

a rear panel;

a first side panel;

a second side panel;

a top panel; and a bottom panel;

the front panel being connected and spaced from said rear panel by said top panel, bottom panel, first side panel and second side panel to form a body;

a first support structure for supporting the body in a first orientation and a second support structure for supporting the body when the body is a second orientation, the first orientation being rotated substantially 90° from said second orientation, wherein said second support structure includes a rigid plate wholly detachably mountable to the duffle bag so as to cover at least partially said bottom panel, when mounted.

2. The duffle bag of claim 1, wherein said first structure includes a rigid member disposed within said body on said rear panel and runners mounted on said rear panel said rear panel being disposed between said runners and said rigid member.

3. The duffle bag of claim 1, wherein said second support structure further includes a first projection mounted on said bottom panel and a second projection at least partially mounted at said bottom panel, a spaced distance from said first projection.

4. The duffle bag of claim 3, wherein at least one of said projections is a wheel.

5. The duffle bag of claim 4, wherein said at least one of said projections is a foot.

6. The duffle bag of claim 1, wherein said second support structure further includes a first rigid plate and a second rigid plate, said first and second rigid plates being affixed to said bottom panel, said second rigid plate being pivotable relative to said first rigid plate with folding of said bottom panel.

7. The duffle bag of claim 6, wherein said first projection is affixed to said first rigid plate and said second projection is affixed to said second rigid plate.

8. The duffle bag of claim 6, wherein said rigid plate, when mounted covers portions of both said first rigid plate and said second rigid plate so as to prevent relative pivoting therebetween.

9. The duffle bag of claim 1, further comprising at least one pocket disposed on at least one of said front panel, first side panel and second side panel, said at least one pocket including a slit therein, said slit opening substantially perpendicular to said first orientation.

10. A duffle bag comprising:

a soft front panel;

soft rear panel;

a soft first side panel;

a soft second side panel;

a soft top panel; and a soft bottom panel;

the front panel being connected and spaced from said rear panel by said top panel, bottom panel, first side panel and second side panel to form a body;

a first support structure for supporting the body in a first orientation and a second support structure for supporting the body when the body is a second orientation, the first orientation being rotated substantially 90° from said second orientation, wherein said rear panel is supportedly mounted to said first support structure, said bottom panel is supportedly mounted to said second support structure, and wherein said front panel, said first side panel said second side panel, and said top panel are collapsible.

11. A duffle bag comprising:

a plurality of soft panels, a first support structure rigidly mounted to a first of said soft panels, a second support structure rigidly mounted to a second of said soft panels, wherein said second support structure is disposed generally perpendicularly to said first support structure, and wherein said soft panels not rigidly mounted to said support structures are collapsible.

* * * * *